US008657907B2

(12) United States Patent
Meusel et al.

(10) Patent No.: US 8,657,907 B2
(45) **Date of Patent: *Feb. 25, 2014**

(54) TUBULAR CAMSHAFT WITH INTEGRATED OIL SEPARATOR

(75) Inventors: Juergen Meusel, Dittmannsdorf (DE); Ulf Mueller, Chemnitz (DE)

(73) Assignee: Thyssenkrupp Presta Teccenter AG, Eschen (LI)

( * ) Notice: Subject to any disclaimer, the term of this patent is extended or adjusted under 35 U.S.C. 154(b) by 24 days.

This patent is subject to a terminal disclaimer.

(21) Appl. No.: 13/695,302

(22) PCT Filed: Feb. 23, 2011

(86) PCT No.: PCT/EP2011/052656

§ 371 (c)(1),
(2), (4) Date: Jan. 16, 2013

(87) PCT Pub. No.: WO2011/151089

PCT Pub. Date: Dec. 8, 2011

(65) Prior Publication Data

US 2013/0118357 A1 May 16, 2013

(30) Foreign Application Priority Data

Jun. 2, 2010 (DE) ..... 10 2010 022 483
Aug. 10, 2010 (DE) ..... 10 2010 033 955

(51) Int. Cl.
*B01D 46/18* (2006.01)

(52) U.S. Cl.
USPC ..... 55/405; 55/357; 55/400; 55/413; 55/447; 55/456; 55/457; 55/459.1; 96/400; 96/217

(58) Field of Classification Search
USPC ..... 55/357, 400, 413, 447, 456, 457, 459.1, 55/405; 96/217, 400
See application file for complete search history.

(56) References Cited

U.S. PATENT DOCUMENTS 4,329,968 A 5/1982 Ishikawa
5,902,378 A * 5/1999 Obrejanu ..... 95/248
7,717,101 B2 5/2010 Beetz

FOREIGN PATENT DOCUMENTS

DE 102004006082 A 8/2005

* cited by examiner

*Primary Examiner* — Dung H Bui
(74) *Attorney, Agent, or Firm* — Andrew Wilford

(57) ABSTRACT

A cam shaft has a tubular part extending longitudinally along an axis and a helical body fixed in the tubular part and having a first helical passage extending between an inlet end where a first pressure is present and an outlet end where a second pressure is present. This helical body forms an oil separator between the inlet and outlet ends. A flow-blocking element at the inlet end moves as a function of a pressure differential between the first and second pressures to open and close the first helical passage.

14 Claims, 7 Drawing Sheets

TUBULAR CAMSHAFT WITH INTEGRATED OIL SEPARATOR

CROSS REFERENCE TO RELATED APPLICATIONS

This application is the US-national stage of PCT application PCT/EP2011/052656 filed 23 Feb. 2011 and claiming the priority of German patent application 102010022483.9 itself filed 2 Jun. 2010 and German patent application 102010033955.5 itself filed 10 Aug. 2010.

FIELD OF THE INVENTION

This invention relates to at least one hollow body, part of which is tubular, comprising an oil separator integrated in a cavity of the hollow body, where a first pressure is present at an outlet end of the oil separator and a second pressure is present at an inlet end of the oil separator. The hollow body can be in the form of a shaft, in particular a camshaft, the cavity then being in a tubular shaft section.

BACKGROUND OF THE INVENTION

Internal-combustion engines and piston compressors often have leakage losses in practical use that can be traced to an incomplete seal. These leakage losses are called blowby gas and contain a considerable quantity of oil. The typical approach in terms of internal-combustion engines is therefore to pass the blowby gas accumulating on the camshaft back into the intake of the internal-combustion engine. A known approach for both minimizing the loss of oil caused by the blowby gas, and also to ensure optimal combustion and minimum pollution of the environment, is to have the blowby gas undergo an oil separation process and to return the separated oil back into the oil circuit. At the same time, the goal here is to design the corresponding oil separation systems to be as simple as possible, yet still reliable.

A hollow body in the form of a shaft having the above-described features has been disclosed in WO 2006/119737 [U.S. Pat. No. 7,717,101], where, in addition to a pre-separator disposed around the outer circumference of the shaft, a swirl generator integrated in the tubular section of the shaft is provided as the final separator. The oil separator must be designed so as to achieve a satisfactory separation of oil during both low and high volumetric flows of blowby gas.

In addition, oil separators are known that are installed outside the shaft, that is, outside a cylinder head cover holding a camshaft. Oil separators of this type, such as, for example, that described in DE 10 2004 006 082, are expensive to construct as separate physical units and require extra installation space.

OBJECT OF THE INVENTION

The object of this invention is to provide a hollow body comprising an oil separator integrated in a cavity, which separator has an improved separation performance, and, in particular allows for variable adaptation to low and high volumetric flows.

SUMMARY OF THE INVENTION

The object is achieved according to the invention by a hollow body at least part of which is cylindrically tubular, in particular a cam shaft, comprising an oil separator integrated in a cavity of the hollow body, where a first pressure is present at an outlet end of the oil separator and a second pressure is present at an inlet end of the oil separator, and where the shaft is characterized by a multipassage helical body that is rotationally fixed to the tubular shaft part, this body being the oil separator, and a flow-blocking element that on the inlet end opens or closes access to the at least one the helical passage of the multipassage spiral body as a function of the pressure differential between the second pressure and the first pressure. The cavity can be provided in the form of a shaft, in particular a camshaft, wherein the cavity is a tubular section of the shaft. However, the hollow body can also be provided, for example, as a separate fixed element in the cylinder head cover of an engine.

The invention thus discloses a hollow body, in particular a shaft, comprising an integrated oil separator that can be switched in stages between inlet end and outlet end as a function of the pressure differential, that is, as a function of the volumetric flow. Whereas the prior art entails providing a fixed geometry that represents a compromise for varying volumetric flows and pressure differentials that occur thereby, the shaft according to the invention provides an effective separation of oil by the oil separator together with a simultaneously limited increase in the pressure drop over a wide range of volumetric flows for the blowby gas.

The oil separator that is integrated in the cavity or the tubular shaft part is provided in the form of a multipassage helical body that is rotationally fixed to the cavity or tubular shaft part, the individual the helical passages running parallel to each other relative to the flow direction of the blowby gas. Separation is effected by centrifugal forces, the width of the helical passages measured axially advantageously decreasing toward the outlet end, which aspect corresponds to a decreasing pitch in the individual the helical passages. What must be taken into account here is that a certain flow velocity and correspondingly a certain pressure differential must be present in order to generate the centrifugal force required for effective separation of the oil. In order to maintain the desired pressure given a low volumetric flow of the blowby gas, the invention then teaches an approach whereby a small flow cross-section is provided by having only access to one of the multiple the helical passages open. The separation by one of the helical passages here can be optimized for a difference in pressure and a corresponding flow velocity, which occur even with a low volumetric flow.

In order to prevent excessive pressure drops when the volumetric flow increases, the invention then teaches increasing the flow cross-section by opening another of the helical passages or additional helical passages. In this way, at least access to one of the helical passages is closed below a predetermined pressure differential and is opened by the flow-blocking element when a predetermined pressure differential has been exceeded.

An embodiment is preferred in which the helical body has at least three helical passages, wherein a second and a third helical passage are opened sequentially by the flow-blocking element as the pressure differential increases.

As is explained below, the flow-blocking element can be a slide valve, pin, or the like, the flow-blocking element being moved by the effective pressure differential, for example, against the force of a spring. In particular provision can be made whereby sequentially opening additional helical passages entails first opening the corresponding access points only partially, then finally opening them completely when the flow-blocking element travels further. Typically, provision is made whereby all of the helical passages are opened in an end position of the flow-blocking element in response to a large pressure differential between the inlet end and the outlet end so as to provide a maximum flow cross-section for oil separation.

In a preferred embodiment of the invention, access to a first helical passage is not always completely closed since a separation of oil from the blowby gas should occur even when the volumetric flow rates are low. The invention thus comprises embodiments in which in response to a small pressure differential access to the first helical passage is opened completely, or is partially covered and thus partially closed, by the flow-blocking element in a first end position of the flow-blocking element so as to reduce the flow cross-section further, or so as to bring about an increase in the pressure differential when volumetric flows are low.

Another flow path can also be provided that is independent of the helical passages, which path runs parallel to the helical passages and is provided with a blowby valve on the inlet end, this being done in order to divert very large volumetric flows of blowby gas that may occur, for example, when the internal-combustion engine is under high loads or when there is a defect in the internal-combustion engine In order to ensure that the flow-blocking element is adjusted independently of the pressure differential between the inlet end and the outlet end of the oil separator, the first pressure must act on one side of the flow-blocking element and the second pressure must act on the other side of the flow-blocking element. In particular the helical body can preferably include a central passage that connects one side of the flow-blocking element to the outlet end of the oil separator. As part of this embodiment, the flow-blocking element can also include the above-described bypass valve that leads from the inlet end of the oil separator into the passage and thus connects directly to the outlet end when a maximum pressure differential is exceeded.

The invention yields a variety of possible approaches in terms of further embodiments of the helical body and the flow-blocking element. In a first further embodiment, the flow-blocking element is disposed in a inner chamber for the helical body, which space is open toward the inlet end of the oil separator, wherein the helical passages are respectively connected through a port to the inner chamber. The ports to the individual helical passages are successively opened by moving the flow-blocking element longitudinally within the receiving body such that, as described above, preferably the first helical passage is at least not completely closed in each position of the flow-blocking element.

In principle, a variety of measures are possible that enable the individual ports to be opened. Thus, ports opening into the inner chamber can, for example, lie along a circumferential line of the inner chamber, wherein the flow-blocking element then has recesses of varying depth on its end facing the inlet end, the recesses being associated with the individual ports. In a preferred embodiment of the invention, however, provision is made such that the ports for the various helical passages are longitudinally offset relative to each other, the flow-blocking element being implemented as a simple internal pin. This embodiment is characterized by an especially simple design whereby integration of the flow-blocking element in the helical body enables installation space to be minimized. Embodying the flow-blocking element as an internal pin that can slide longitudinally also easily allows more than three helical passages to be opened and closed, whereby the internal pin also allows for simple integration of a bypass valve.

The motion of the internal pin is typically limited by stops that simultaneously secure the internal pin against dropping out. Stops can be composed, for example, of steps inside the inner chamber, rings, screws, or the like. Installing the internal pin from the inlet end of the helical body when the shaft is produced provides the ability to have the range of motion of the pin limited by a step toward the outlet end, and limited by a separate element in the form of a ring or a screw toward the inlet end.

A precise fit must be maintained in the described embodiment of the flow-blocking element as an internal pin, which fit both provides the permanent movability of the internal pin and also ensures a sufficient seal for the pin relative to the inner chamber.

While the cavity or tubular shaft part in the described embodiment has one or multiple inlets that supply the second pressure to the flow-blocking element and also pass the blowby gas to the helical body, the cavity or tubular shaft part in an alternative embodiment can have radial ports that each communicate directly with one of the helical passages, the flow-blocking element then being a sliding sleeve for controlling the direct entrance of the blowby gas into the individual helical passages as a function of pressure. Generally, an additional port must be provided in the cavity or tubular shaft part in order then to supply the flow-blocking element provided as a sliding sleeve with the inlet-side second pressure In the described embodiment of the flow-blocking element as a sliding sleeve, this sleeve is preferably rotationally fixed to the helical body and provided with openings that are associated with the radial ports of the tubular shaft part in order to sequentially open the individual helical passages as a function of the pressure differential. In particular the radial ports of the cavity or tubular shaft part can be drilled holes and disposed along a circumferential line of the cavity or tubular shaft part, at least one portion of the openings of the sliding sleeve being a slot that extends longitudinally of the helical body, i.e. in particular that of the shaft. Arraying the radial ports of the tubular shaft part along a circumferential line gives the advantage that all of the helical passages between the inlet end and the outlet end have the same length usable for effecting oil separation.

Embodying the flow-blocking element as a sliding sleeve also provides an especially simple means of affecting a force resistance by a spring, the sliding sleeve also allowing for integration of a bypass valve.

According to the invention, the hollow body has at least one cavity to accommodate the hollow body. The cavity here can, in particular be part of a continuously tubular shaft.

BRIEF DESCRIPTION OF THE DRAWING

The following describes the invention with reference to a drawing that shows a single illustrated embodiment. Therein.

DETAILED DESCRIPTION OF THE INVENTION

Figure 1:
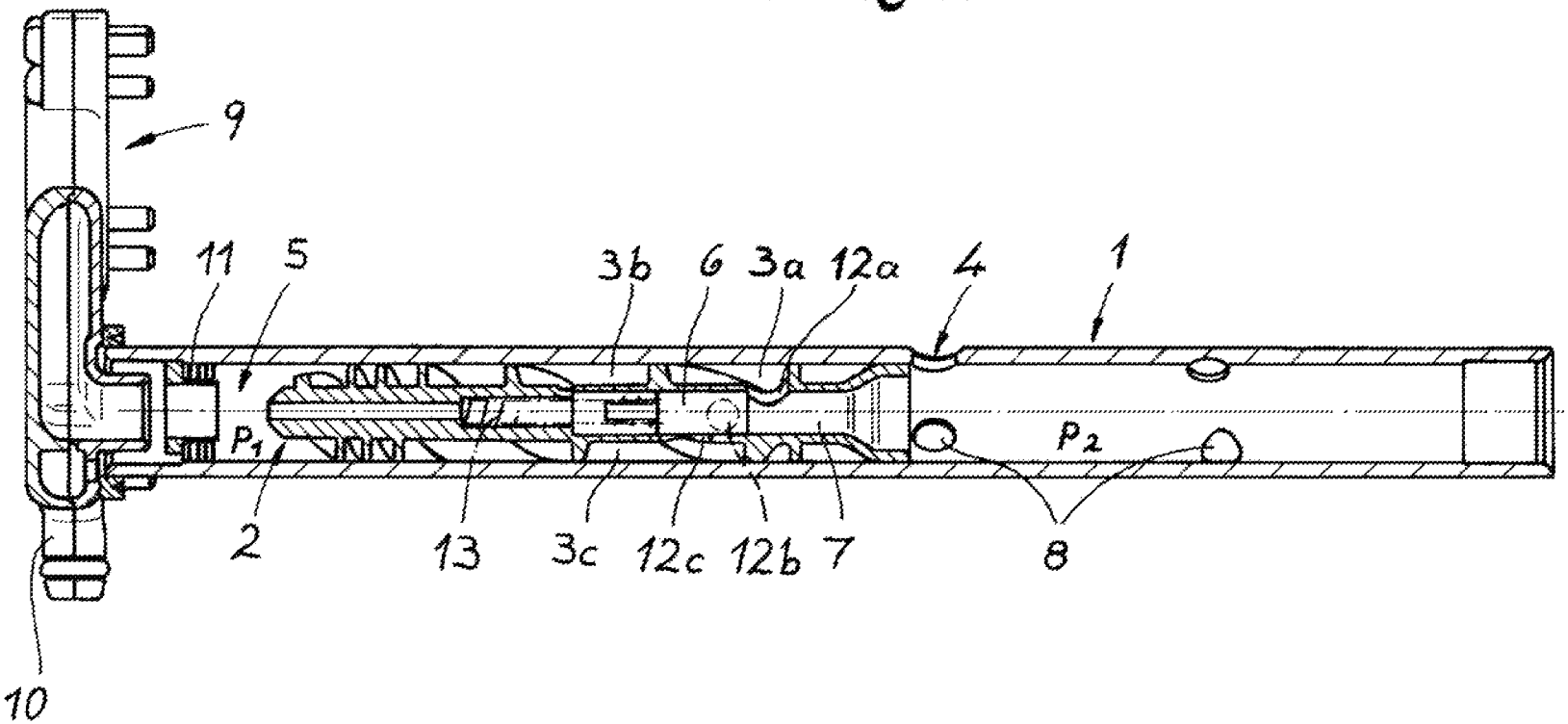
FIG. 1 is a section through a shaft comprising a helical body in the form of an oil separator integrated into a tubular shaft part.

FIG. 1 is a sectional view of a tubular camshaft 1 that has an integrated oil separator in the form of a helical body 2. The helical body 2 shown in a perspective in FIG. 2 has several helices and in the illustrated embodiment forming, by way of example, three helical passages 3*a*, 3*b*, and 3*c*. The helical passages 3*a*, 3*b*, 3*c* of the helical body 2, which is permanently inserted in camshaft 1, are provided with the function of separating oil from the blowby gas such that the flow velocity inside the helical passages 3*a*, 3*b*, 3*c* increases starting from an inlet end 4 toward an outlet end 5 due to a decreasing width and thus decreasing pitch of the helical passages 3*a*, 3*b*, 3*c*, with the result that the oil contained in the blowby gas is thrown outward by the generated centrifugal forces and separated along the inside wall of the tubular camshaft 1. A certain flow velocity must be present here so as to ensure that the oil is separated efficiently. The flow velocity is essentially determined here by a pressure differential Δp between a second pressure $p_2$ at the inlet end 4 of the helical body 2 and a first pressure $p_1$ at the outlet end 5 of the helical body 2.

In order to prevent the pressure differential Δp and thus the flow velocity from being too low for low volumetric flows of blowby gas, the invention teaches that the flow cross-section provided for oil separation is modified as a function of pressure.

In the variant shown in FIG. 1, a flow-blocking element 6 is provided for this purpose in the form of an internal pin that is in an inner chamber 7 of the helical body 2 that is open toward the inlet end 4 of the helical body 2. The inlet end 4 is here formed by an outer region of camshaft 1 and the interior of the tubular camshaft 1 that directly connects to the outer region through intake ports 8.

At the outlet end 5, the blowby gas from which oil has at least mostly been removed is passed through a clean-gas conduit 9 into an intake of an internal-combustion engine such that the separated oil is returned through a corresponding connector 10 to an oil circuit. In order to enable the blowby gas leaving the helical body 2 to undergo a supplemental cleaning, an arrangement of perforated plates is provided according to the invention as an additional oil separator 11.

Figure 2:
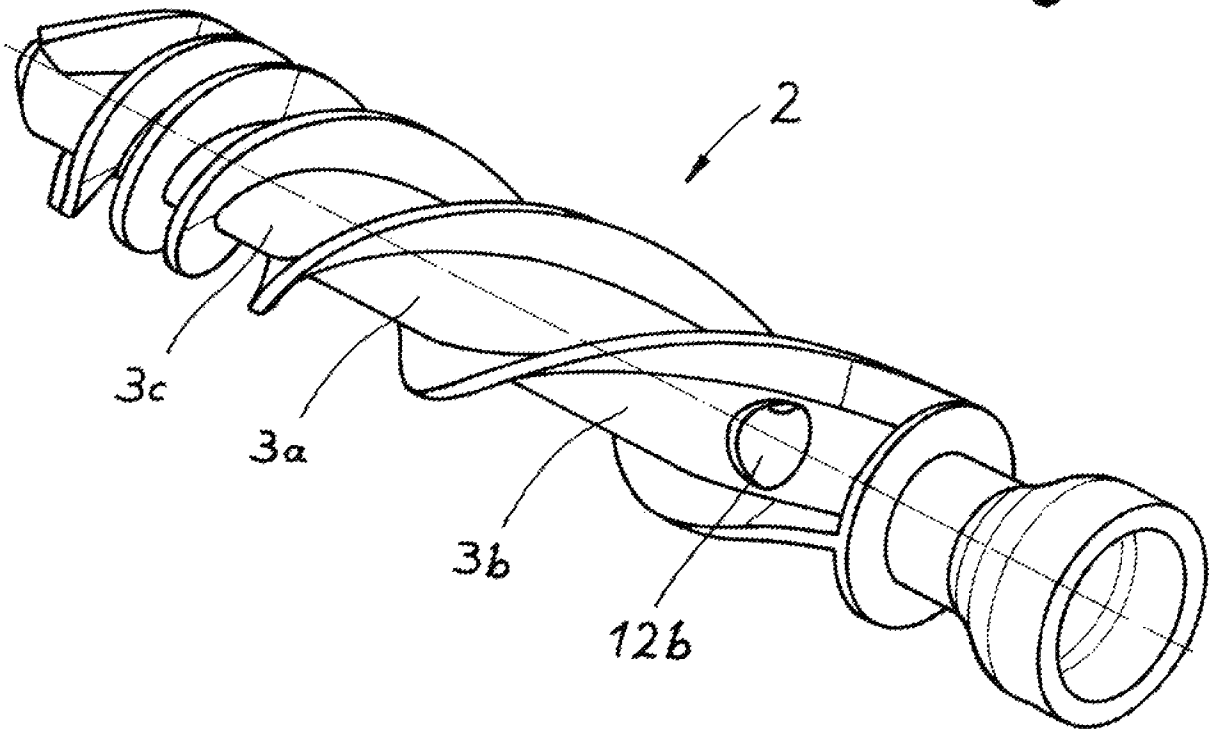
FIG. 2 is a perspective view of the helical body shown in FIG. 1.
Figure 3A:
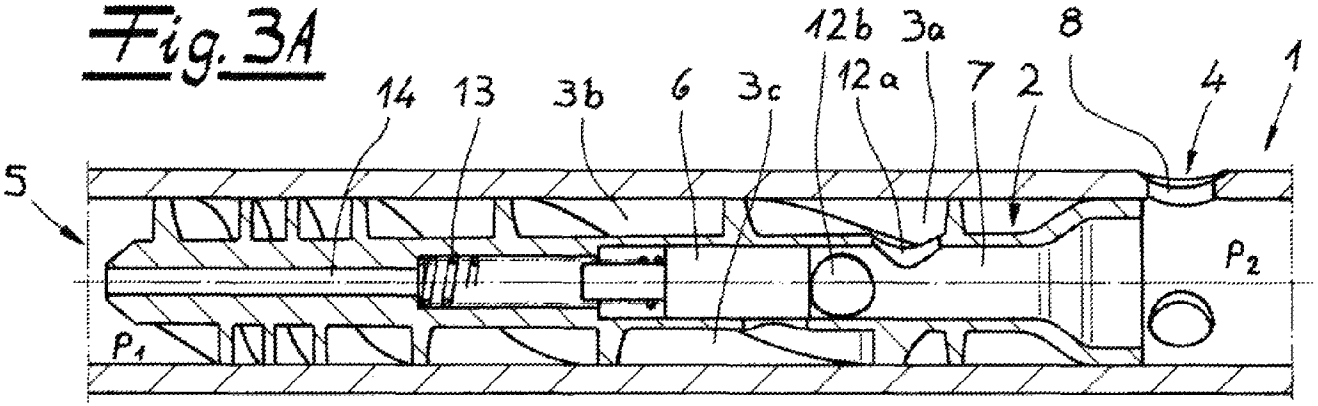
FIGS. 3*a* and 3*b* are sectional detail views of the shaft shown in FIG. 1 that has a modified functional position of the flow-blocking element.
Figure 3B:
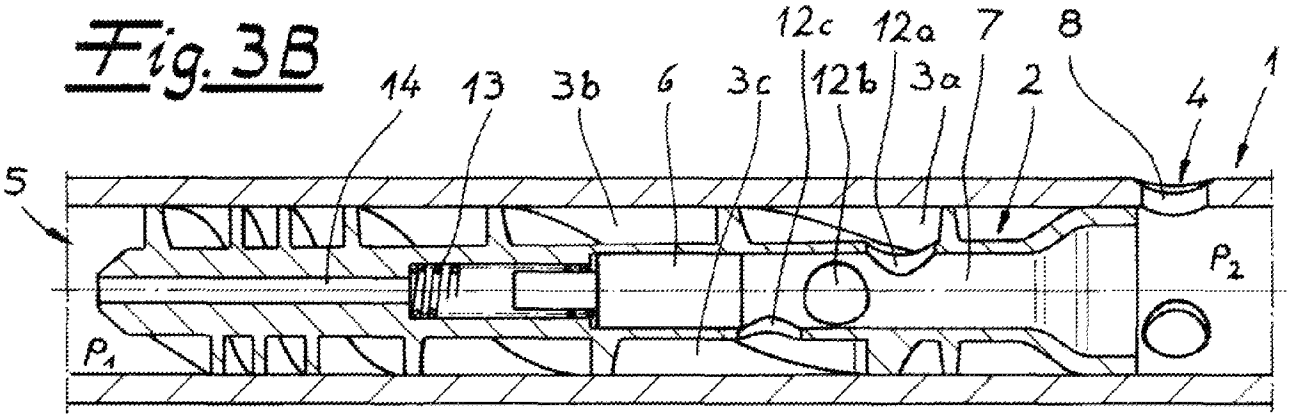

The functional principle of the first variant can be seen by comparing FIGS. 1, 3*a*, and 3*b* that show the flow-blocking element 6 in different functional positions where the pressure differential Δp increases moving from FIG. 1 through FIG. 3*a* up through FIG. 3*b*. In FIGS. 1 and 2, the three helical passages 3*a*, 3*b*, 3*c* are connected through respective ports 12*a*, 12*b*, 12*c* to the inner chamber 7. The flow-blocking element 6 is forced by a spring 13 toward a first end position such that the second pressure $p_2$ acting on the inlet end 4 as well as the first pressure $p_1$ at the outlet end 5 act through a central passage 14 of the helical body 2 on opposite end faces of the flow-blocking element 6.

Due to low volumetric flow of blowby gas, the pressure differential Δp in FIG. 1 is so low that the force exerted by the spring 13 is sufficient to hold the flow-blocking element 6 in the first end position. While the port 12*a* leading to the first helical passage 3*a* is always open, the ports 12*b* and 12*c* leading to the second and third helical passages 3*a*, 3*b* are closed by the flow-blocking element 6 in the first end position of the flow-blocking element 6.

As the volumetric flow of blowby gas increases, the second pressure $p_2$ at the inlet end 4 and thus the pressure differential Δp also increase, with the result that the flow-blocking element 6 is pushed against the force of the spring 13 toward the outlet end 5. As the pressure differential Δp increases, in sequential fashion the first port 12*b* leading to the second helical passage 3*b* is opened, then subsequently the port 12*c* leading to the third helical passage 3*c* is opened. The flow cross-section available for oil separation is increased correspondingly, with the result that an excessive increase in the pressure differential can be avoided and the helical body 2 is operated within a range that is optimal for the separation of oil.

FIGS. 1, 3*a*, and 3*b* show three functional positions, by way of example, in which the port 12*a*, the two ports 12*a*, 12*b*, or all three of the ports 12*a*, 12*b*, 12*c* are opened completely. In the intermediate positions not shown, the port 12*b* leading to the second helical passage 3*b*, or the port 12*c* leading to the third helical passage 3*c*, are partially open, with the result that the cross-section effectively available for oil separation changes uniformly and continuously along the entire path of the flow-blocking element 6.

A blowby valve, not shown in the figures, can be easily integrated into the flow-blocking element 6, the valve leading from the inlet end 4 into the passage 14, so as to relieve any overpressure due to peak loads or fault operation.

FIGS. 4 through 6, and FIGS. 7A through 7C relate to an alternative embodiment of the camshaft 1 according to the invention in which a sliding sleeve is provided as a flow-blocking element 6'. Whereas in the previously described embodiment an internal pin is inserted into the helical body 2 as the flow-blocking element 6, in the alternative embodiment a sliding sleeve is provided as the flow-blocking element 6', which sleeve is mounted with a sleeve section between the inner wall of the tubular the camshaft 1 and the individual helical passages 3*a*, 3*b*, 3*c* of the helical body 2. The camshaft 1 has radial ports 15*a*, 15*b*, 15*c* that are respectively offset by 120°, each of the ports being associated with one of the helical passages 3*a*, 3*b*, 3*c* of the helical body 2. Based on the embodiment described in FIGS. 1, 2, 3*a* and 3*b*, radial ports 15*b*, 15*c* leading into the second and third helical passages 3*b* and 3*c* are opened and closed as a function of the effective pressure differential Δp, while the radial port 15*a* leading into the first helical passage 3*a* is always open or at least not completely closed.

Figure 4:
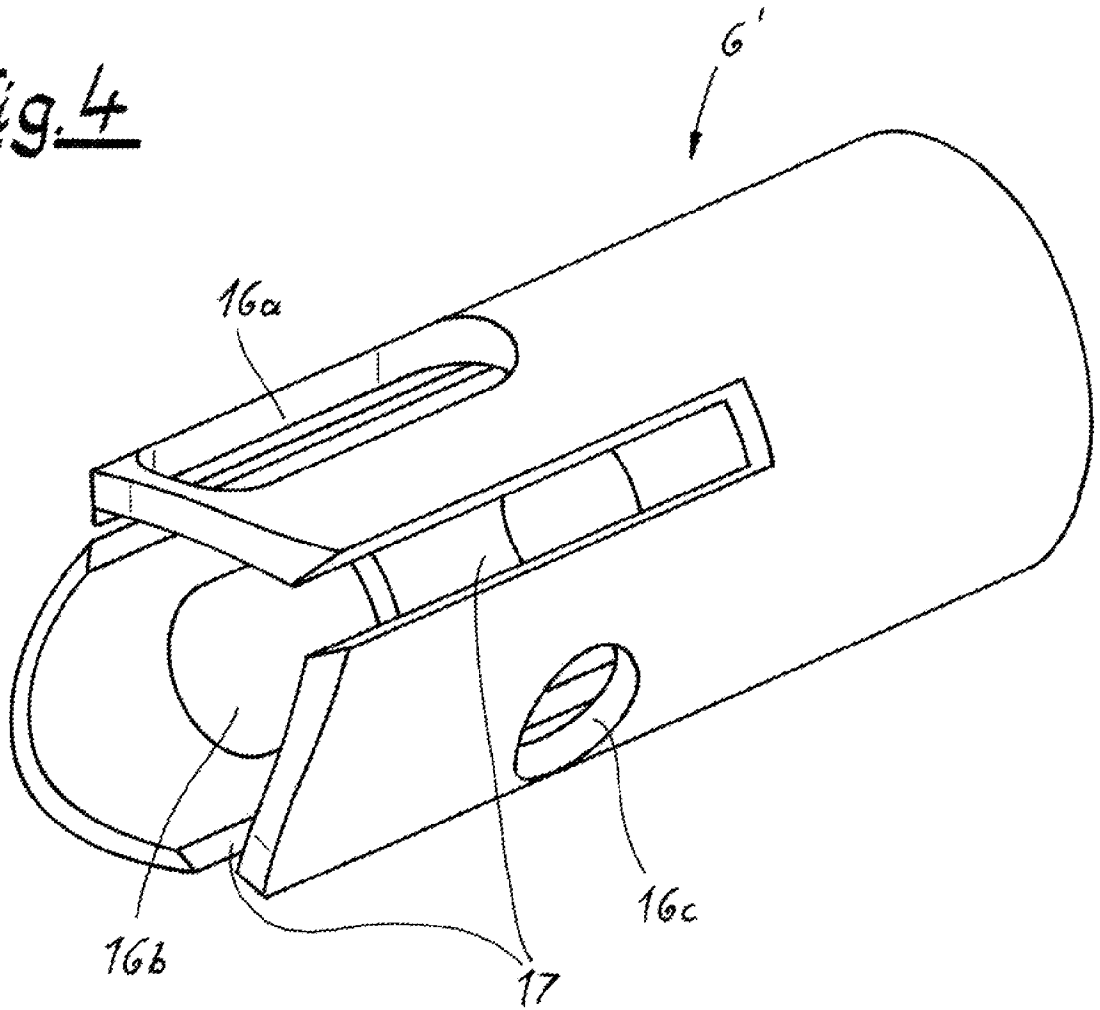
FIG. 4 is a perspective view of an alternative embodiment of a flow-blocking element.
Figure 5:
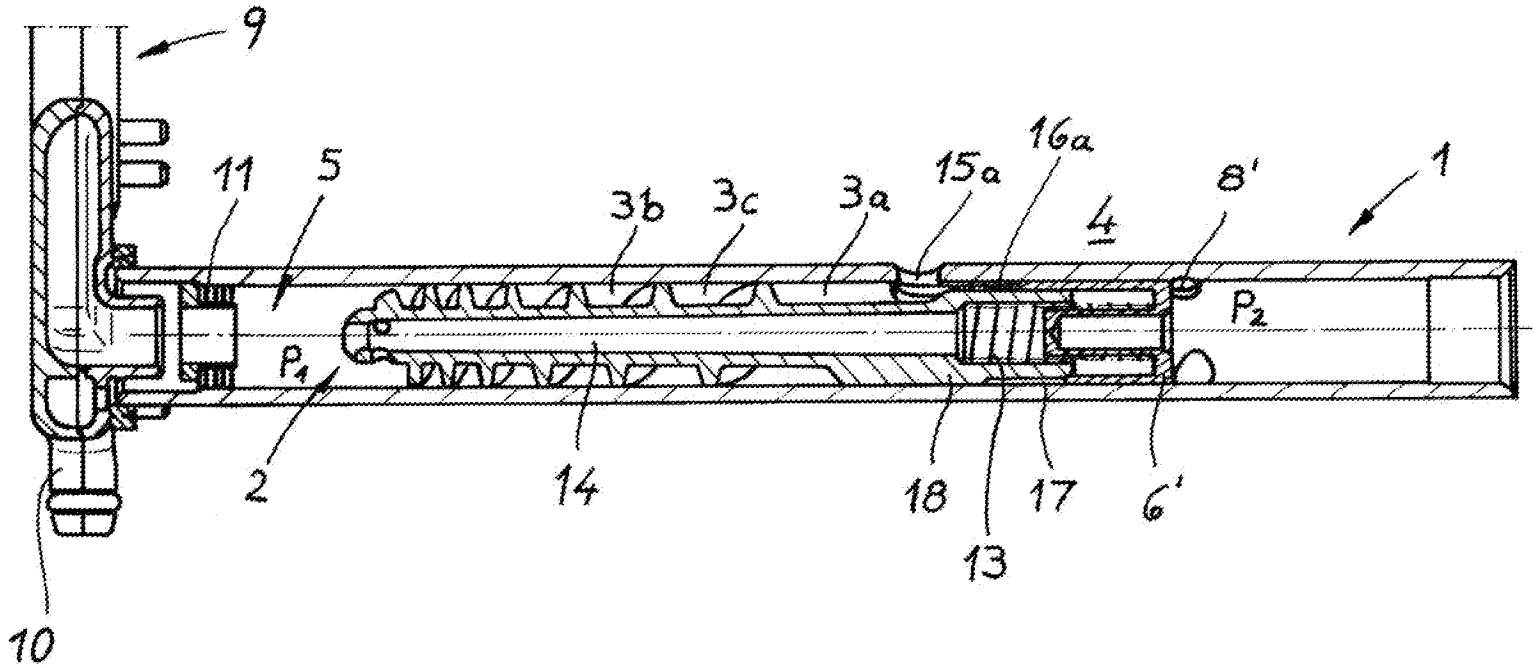
FIG. 5 is a section through an alternative embodiment of the shaft with the flow-blocking element of FIG. 4.

The flow-blocking element 6' of FIG. 4 that is a sliding sleeve has differently shaped openings 16*a*, 16*b*, 16*c* so as to be able to differentially open or close the radial ports 15*a*, 15*b*, 15*c* that are spaced uniformly along a circumferential line, or to keep these open in each functional position. The opening 16*a* associated with the first helical passage 3*a* and with the corresponding radial port 15*a* is a slot such that the connection of the first helical passage 3*a* is always open to the surrounding region of the camshaft 1 and thus to the inlet end 4. The opening 16*b* associated with the second helical passage 3*b* and corresponding radial port 15*b* is a shorter slot, with the result that starting with a low pressure differential Δp the second helical passage 3*b* is initially closed. Finally, the opening 16*c* associated with the helical passage 3*c* and corresponding radial port 15*c* is of circular shape, with the result that the third helical passage 3*c* is completely opened only in the second end position of the flow-blocking element 6'.

Figure 6:
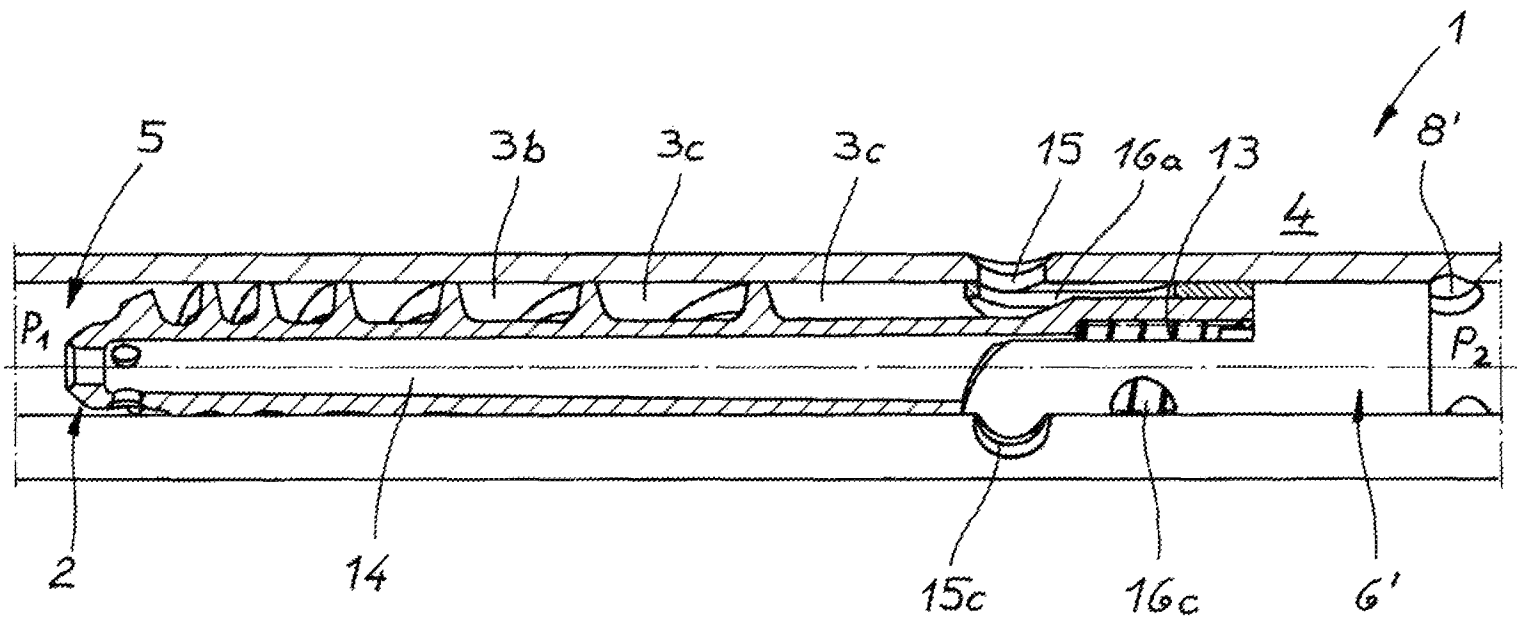
FIG. 6 is a partial section through the shaft of FIG. 5.
Figures 7A, 7B, 7C:
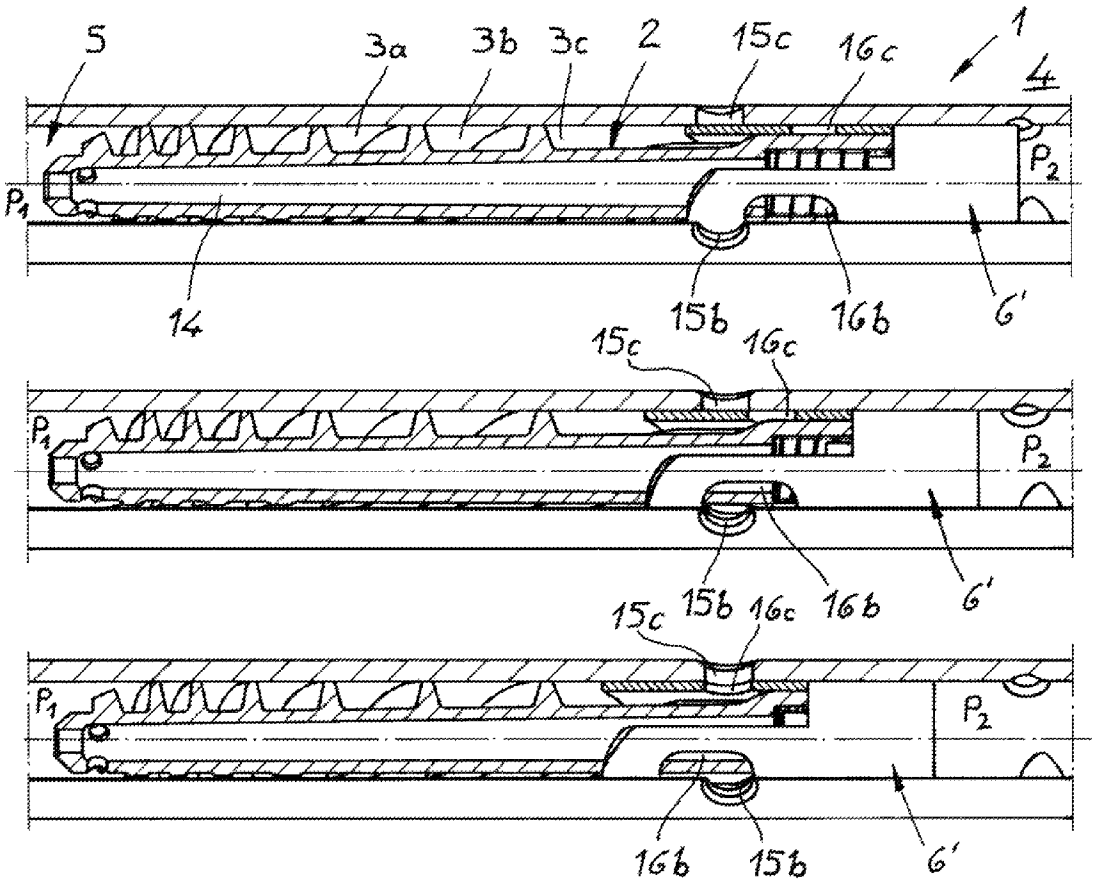
FIG. 7A through FIG. 7C are partial sections through the shaft of FIG. 5 rotated 120° relative to the view of FIG. 6, and with different functional positions of the flow-blocking element shown in FIG. 4.

The described functional positions are shown in FIGS. 6, 7A, 7B, and 7C. The openings 16*a*, 16*c* that are associated with the first helical passage 3*a* and the third helical passage 3*c* are shown in the section of FIG. 6. FIG. 7A shows radial ports 15*b*, 15*c* that are rotated about the longitudinal axis by 120°, which ports lead into the second and third helical passages 3*b*, 3*c*. Only access to the first helical passage 3*a* is opened in the first end position shown.

As in the embodiment shown in FIG. 1, FIG. 2, FIG. 3*a* and FIG. 3*b*, the flow-blocking element 6' is initially held in this position by the spring 13, the central passage 14 within the helical body 2 transmitting the first pressure $p_1$ present at the outlet end 5 to one side of the flow-blocking element 6, and the second pressure $p_2$ at the inlet end 4 acts through the intake ports 8' in the camshaft 1 on the other side of the flow-blocking element 6'. Correspondingly, the flow-blocking element 6' is pushed against the returning force of the spring 13 as the pressure differential Δp increases, with the result that initially the connection between the second helical passage 3*b* and associated radial port 15*b* is opened through the corresponding opening 16*b* of the flow-blocking element 6' (FIG. 7B). As the pressure differential Δp increases further, the flow-blocking element 6' finally moves into a second end position in which all of the helical passages 3*a*, 3*b*, 3*c* are opened (FIG. 7C).

The flow-blocking element 6' can include longitudinal cutouts 17 between the openings 16*a*, 16*b*, 16*c* so as to keep the flow-blocking element 6', in the form of a sliding sleeve, longitudinally movable yet pressure-tight on the helical body 2, the cutouts interacting with corresponding projections 18 of the helical body 2.

The invention claimed is:

1. A shaft comprising:

a tubular part extending longitudinally along an axis;

a helical body fixed in the tubular part and having a first helical passage extending between an inlet end where a first pressure is present and an outlet end where a second pressure is present, the helical body forming an oil separator between the inlet and outlet ends; and a flow-blocking element at the inlet end movable as a function of a pressure differential between the first and second pressures to open and close the first helical passage.

2. The shaft according to claim 1, wherein the flow-blocking element is moved longitudinally movably along the axis and is biased by a spring.

3. The shaft according to claim 1, wherein the helical body further has an auxiliary passage that connects one side of the flow-blocking element to the outlet end.

4. The shaft according to claim 3, wherein the flow-blocking element has a bypass valve between the inlet end into the auxiliary passage.

5. The shaft according to claim 1, wherein the helical passage is closed by the flow-blocking element below a predetermined pressure differential between the first and second pressures, and is opened by the flow-blocking element when the predetermined pressure differential has been exceeded.

6. The shaft according to claim 5, wherein the helical body has in addition to the first helical passage second and third helical passages.

7. The shaft according to claim 6, wherein the second and a third helical passages are opened sequentially by the flow-blocking element as the pressure differential increases.

8. The shaft according to claim 6, wherein one of the helical passages is always open.

9. The shaft according to claim 6, wherein the tubular part has an inner chamber of the helical body that is open toward the inlet end and that holds the flow-blocking element.

10. The shaft according to claim 9, wherein the tubular part is formed with respective ports connecting the helical passages to the inner chamber.

11. The shaft according to claim 10, wherein the ports of the helical passages are longitudinally offset relative to each other, the flow-blocking element being an internal pin.

12. The shaft according to claim 6, wherein the tubular part is formed with radial ports that each lead into a respective one of the helical passages, the flow-blocking element being a sliding sleeve.

13. The shaft according to claim 12, wherein the sliding sleeve is rotationally fixed to the helical body and has openings that are associated with radial ports of the tubular part in order sequentially to open the individual the helical passages as a function of the pressure differential.

14. The shaft according to claim 13, wherein the radial ports of the tubular part are drilled holes and are aligned along a circumferential line of the tubular part, at least one portion of the openings of the sliding sleeve being a slot that extends parallel to the axis.

* * * * *